US007410074B1

(12) United States Patent
Brunning

(10) Patent No.: US 7,410,074 B1
(45) Date of Patent: Aug. 12, 2008

(54) PAINT BUCKET

(76) Inventor: Robert Brunning, 9207 Powderhorn Dr., Fountain Hills, AZ (US) 85268

( * ) Notice: Subject to any disclaimer, the term of this patent is extended or adjusted under 35 U.S.C. 154(b) by 757 days.

(21) Appl. No.: 10/932,464

(22) Filed: Sep. 2, 2004

(51) Int. Cl.
*B05C 21/00* (2006.01)
*B65D 25/00* (2006.01)

(52) U.S. Cl. ..... 220/570; 220/696; 220/697; 220/633; 15/257.06

(58) Field of Classification Search ..... 220/570, 220/752, 754, 771, 571, 571.1, 572, 639–654, 220/660–693, 481, 482, 477, 751, 480, 695, 220/697, 699; 15/257.05; 224/148.5; D32/53.1
See application file for complete search history.

(56) References Cited

U.S. PATENT DOCUMENTS

| | | | | | |
|---|---|---|---|---|---|
| D202,134 | S | | 8/1965 | Bryan | |
| 3,292,815 | A | | 12/1966 | Smith et al. | |
| 3,493,988 | A | | 2/1970 | Tidwell | |
| 3,829,926 | A | | 8/1974 | Salladay | |
| 4,205,411 | A | * | 6/1980 | Cupp et al. | 15/257.06 |
| 4,266,686 | A | * | 5/1981 | Carter | 220/697 |
| 4,297,762 | A | | 11/1981 | Crysdale | |
| 4,561,556 | A | * | 12/1985 | Bendix | 220/697 |
| D303,304 | S | | 9/1989 | Sabatino | |
| 5,046,749 | A | | 9/1991 | Owens | |
| 5,314,061 | A | * | 5/1994 | Bedrossian | 206/229 |
| 5,341,969 | A | * | 8/1994 | Accardo et al. | 222/465.1 |
| D355,287 | S | | 2/1995 | Camp, Jr. | |
| 5,400,916 | A | * | 3/1995 | Weber | 220/495.02 |
| 5,810,196 | A | | 9/1998 | Lundy | |
| 5,829,628 | A | * | 11/1998 | Lount | 220/695 |
| 5,941,410 | A | * | 8/1999 | Mangano | 220/735 |
| 5,966,772 | A | * | 10/1999 | Woodnorth et al. | 15/230.11 |
| 6,062,389 | A | * | 5/2000 | Kent | 206/518 |
| 6,105,816 | A | * | 8/2000 | Shea | 220/697 |
| 6,176,389 | B1 | * | 1/2001 | de Laforcade | 220/695 |
| 6,199,718 | B1 | | 3/2001 | Ellis | |
| 6,260,730 | B1 | * | 7/2001 | Fellman | 220/495.02 |
| D458,723 | S | * | 6/2002 | Malvasio | D32/53.1 |
| D477,702 | S | | 7/2003 | Kohn | |
| 6,622,340 | B2 | * | 9/2003 | Rosa | 15/257.06 |
| 7,191,913 | B2 | * | 3/2007 | Byrne | 220/570 |
| 2002/0096525 | A1 | * | 7/2002 | Bertoldo et al. | 220/544 |
| 2004/0195248 | A1 | * | 10/2004 | Garcia | 220/570 |

* cited by examiner

*Primary Examiner*—Anthony D Stashick
*Assistant Examiner*—Ned A Walker
(74) *Attorney, Agent, or Firm*—Parsons & Goltry; Michael W. Goltry; Robert A. Parsons

(57) ABSTRACT

A paint bucket includes an upstanding continuous sidewall incorporating opposing sidewalls, and opposing front and rear walls. The rear wall has two first support panels each adjoining one of the opposing sidewalls, a central panel having a width and an upper end including an upper edge, and a lower concave end leading to an opposing lower edge adjoining a bottom wall of the paint bucket. A horizontal support panel, having a width equal to the width of the central panel, adjoins the upper edge of the rear wall and the upper edge of the central panel. Two second support panels each adjoin one of the first support panels, the central quadrilateral panel, and the horizontal support panel, and opposing openings are provided through the horizontal support panel each for accommodating therein a paint accessory.

22 Claims, 4 Drawing Sheets

10
11
12
13
14
15
17
20
21
22
23
24
25
30
31
32
33
34
35
48
49

4
10
11
12
13
14
15
16
17
20
21
22
23
25
30
31
32
33
34
35
35A
35B
35C
40
41
42
43
44
45
48
49
22A
22B 10
11
12
13
14
15
16
17
20
21
22
23
24
25
30
31
32
33
34
35
36
46
47
50
51

10
11
12
13
14
15
16
17
21
22
22A
22B
22C
23
24
25
31
33
34
35
40
41
42
43
49

PAINT BUCKET

BACKGROUND OF THE INVENTION

1. Field of the Invention

This invention relates to paint buckets.

2. The Prior Art

The prior art is replete with buckets of various types and styles. Of immediate interest are paint buckets for receiving paint, stain, and the like, in a quantity and at a level that is suitable for loading a paint roller with a desired and controllable amount of liquid for transferring and spreading the liquid onto a selected surface.

Common to many prior art paint buckets is an upstanding continuous sidewall having a closed bottom, and an open top, in which the closed bottom cooperates with the sidewall forming a fluid impervious receptacle. In the receptacle there is usually a textured panel, or a grate, that is used to control the amount of liquid on the brush or roller being used. Some paint buckets even incorporate features for use in holding paint brushes. Although the art enjoys many types of the above-described paint buckets and variances thereof, it would be highly desirable to provide a paint bucket that is easy to construct, highly stable, that incorporates specialized features specifically adapted for use with a paint roller, that incorporates unique storage features for storing paint brushes and towels and other items, and that has a uniquely-configured rear wall for introducing structural rigidity to the paint bucket, and in which the storage features are uniquely positioned so that instability is not imparted to the paint bucket with items are attached thereto for storage purposes.

SUMMARY OF THE INVENTION

According to the invention, there is provided a paint bucket consisting of an upstanding continuous sidewall including opposing sidewalls having upper and lower edges, and opposing front and rear walls having upper and lower edges, the upper edges of the sidewalls and the front and rear walls defining a continuous upper edge, defining an upper plane, of the continuous sidewall. A substantially horizontal bottom wall, adjoined to the lower edges of the sidewalls and the front and rear walls and defining a bottom plane, cooperates with continuous sidewall to form a fluid impervious receptacle. The upper plane is substantially parallel to the lower plane. According to the invention, the rear wall includes 1) two first support panels each adjoining one of the opposing sidewalls; 2) a central quadrilateral panel, of sufficient width to accommodate a roller, having a curvature, of a paint roller, the central quadrilateral panel having an upper end including an upper edge, and a lower concave end leading to an opposing lower edge adjoining the bottom wall, the lower concave end for accommodating the curvature of the roller; 3) a horizontal support panel, having a width equal to the width of the central quadrilateral panel and residing in the upper plane, opposing first and second end edges, a first side edge adjoining the upper edge of the rear wall, and a second side edge adjoining the upper edge of the central quadrilateral panel; 4) the lower edge of the central quadrilateral panel sufficiently inset from the upper edge of the central quadrilateral panel to form an incline between the lower edge of the central quadrilateral panel and the upper edge of the central quadrilateral panel; 5) two second support panels each adjoining the central quadrilateral panel, one of the first support panels, and one of the first and second end edges of the horizontal support panel; 6) a first opening through the horizontal support panel adjacent the first end edge between the first and second side edges; and 7) a second opening through the horizontal support panel adjacent the second end edge between the first and second side edges. A pair of opposing storage hooks is affixed to the upper edge of the rear wall between the two second support panels. The paint bucket is sized so that the paint bucket is nestable with a duplicate paint bucket. A central spout is formed at the upper edge of the front wall, and the central quadrilateral panel and is corrugated. The front wall has a lower concave end leading to a lower edge adjoining the bottom wall, the lower concave end of the front wall for accommodating the curvature of the paint roller. A handle, pivotally attached to the paint bucket, is used to carry the paint bucket.

BRIEF DESCRIPTION OF THE DRAWINGS

Referring to the drawings.

DETAILED DESCRIPTION OF A PREFERRED EMBODIMENT

A paint bucket 20 will now be described with reference to FIGS. 1-8.

Figure 1:
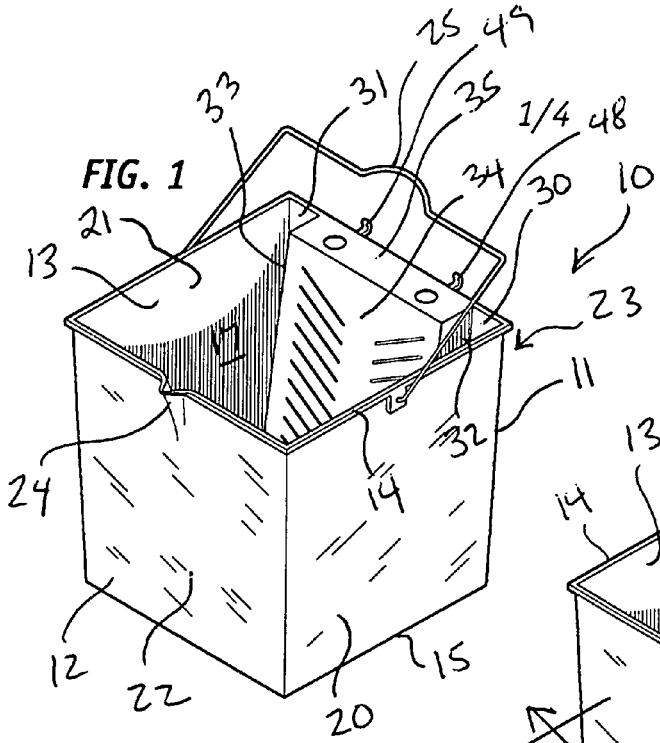
FIG. 1 is a front isometric view of paint bucket, constructed and arranged in accordance with the principle of the invention.
Figure 5:
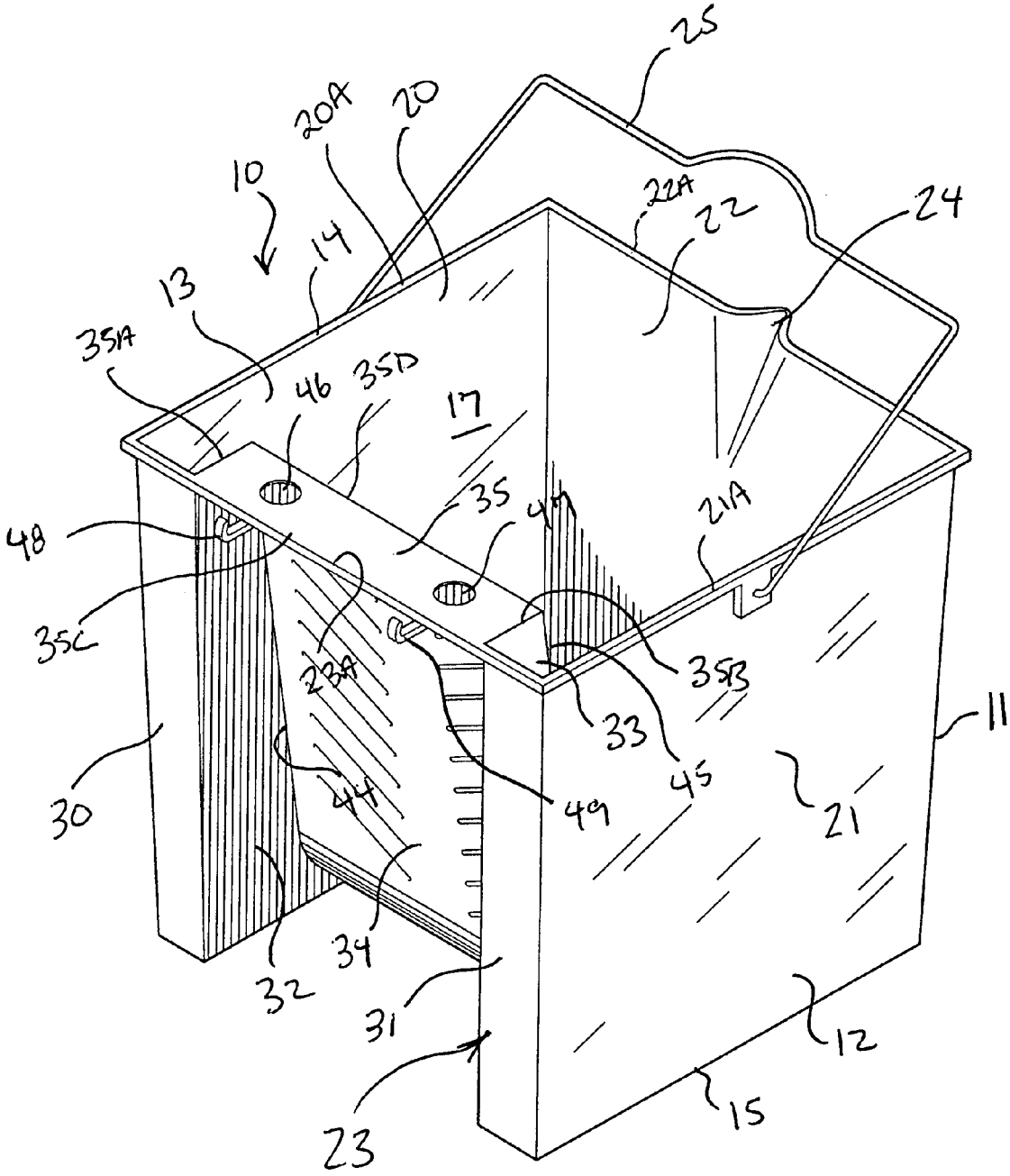
FIG. 5 is a rear isometric view of the paint bucket of FIG. 1.

Turning now to the drawings, in which like reference characters indicate corresponding elements throughout the several views, attention is first directed to FIGS. 1 and 5 in which there is seen a paint bucket, generally indicated by the reference character 10, consisting of an upstanding continuous sidewall 11 having an outer surface 12, an inner surface 13, a continuous upper edge 14 defining a horizontal upper plane, and a lower edge 15. As further seen in FIGS. 2 and 3, bucket 10 further includes a horizontal bottom wall 16 affixed to inner surface 13. Bottom wall 16 resides in a horizontal lower plane that is substantially parallel to the upper plane defined by continuous upper edge 14, and cooperates with continuous sidewall 11 to form a fluid impervious receptacle 17. Preferably, bucket 10 is integrally formed or molded of a substantially rigid material such as a selected thermoplastic material, metal, fiberglass, etc.

Continuous sidewall 11 is generally square in shape and is made up of four walls, namely, opposing sidewalls 20 and 21, and opposing front and rear walls 22 and 23. Looking to FIG. 6, which is a top plan view of bucket 10, sidewall 20 has opposing upper and lower edges 20A and 20B, sidewall 21 has opposing upper and lower edges 21A and 21B, front wall 22 has opposing upper and lower edges 22A and 22B, and rear wall 23 has opposing upper and lower edges 23A and 23B. Upper edges 20A,21A,22A,23A cooperate and define continuous upper edge 14. Bottom wall 16 adjoins lower edges 20B,21B,22B,23B. A central spout 24 for pouring is formed at upper edge 22A of front wall 22. A handle 25, made of metal wire, has ends pivotally attached to sidewalls 20 and 21 at upper edges 20A and 21A, respectively, in a conventional manner, and is used to carry paint bucket 10.

According to the invention, and with reference to FIG. 5, rear wall includes two first support panels 30 and 31, two second support panels 32 and 33, a central panel 34, and a horizontal support panel 35. First support panel 30, which is a quadrilateral panel, adjoins sidewall 20, and first support panel 31, which is also a quadrilateral panel, adjoins sidewall 21. Looking momentarily to FIG. 3, central panel 34 is a quadrilateral panel and has a width that is sufficient to accommodate a roller 36, having a curvature, of a paint roller 37.

Figure 2:
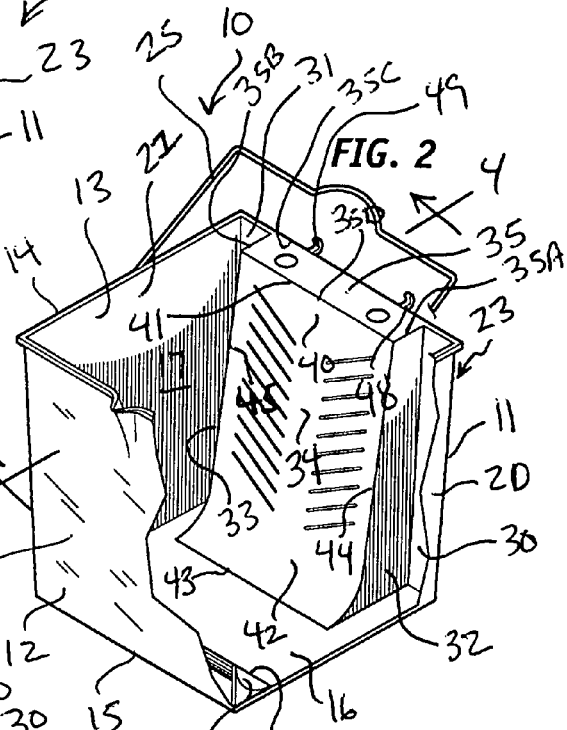
FIG. 2 is an isometric view of the paint bucket of FIG. 1 with portions thereof broken away for illustrative purposes.

Referring to FIG. 2, central panel 34 has an upper 40 end including an upper edge 41, a lower concave end 42 leading to an opposing lower edge 43 adjoining bottom wall 15, and opposing side edges 44 and 45. Lower concave end 42 is sufficiently inwardly curved for accommodating the curvature of roller 36 of paint roller 37. The width of central panel 34 is substantially constant from its upper edge 41 to its lower edge 43. Looking to FIG. 4, lower edge 43 of central panel 34 is sufficiently inset from upper edge 41 of central panel 34 to form an incline between lower edge 43 of central panel 34 and upper edge 41 of central panel 34. The entirety of central panel 34 is inset into receptacle 17 from upper edge 23A of rear wall 23.

Figure 4:
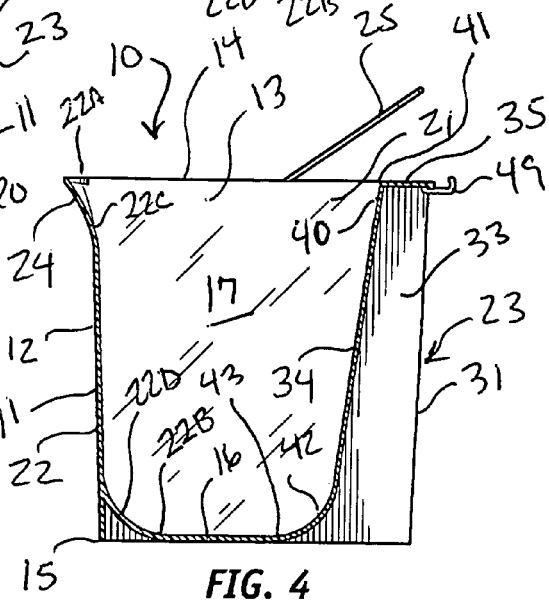
FIG. 4 is a sectional view taken along line 4-4 of FIG. 2.
Figure 6:
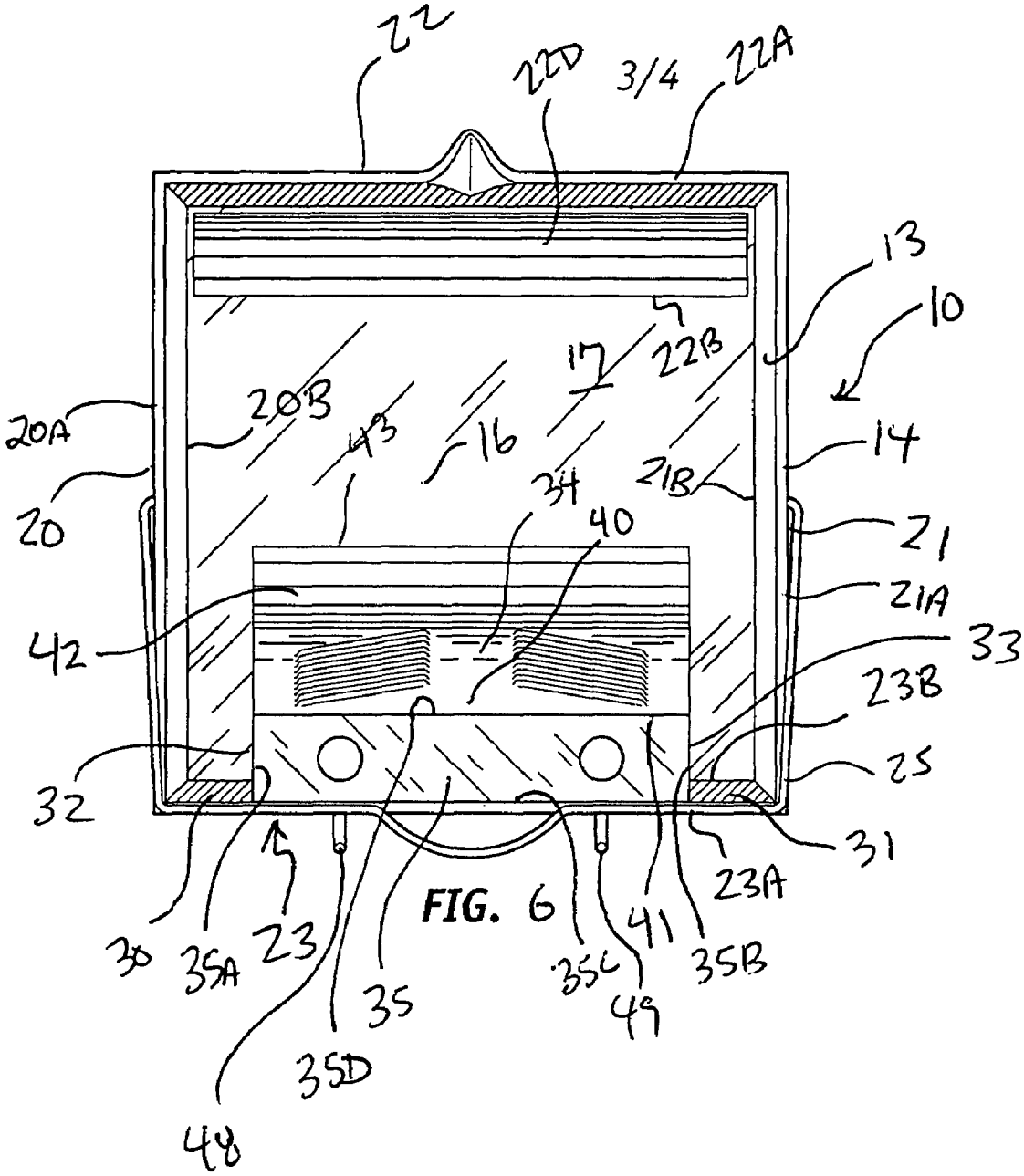
FIG. 6 is a top plan view of the paint bucket of FIG. 1.

Like central panel 34, front wall 22, as seen in FIG. 4, has an upper end 22C including upper edge 22A, and lower concave end 22D leading to lower edge 22B adjoining bottom wall 16. Lower concave end 22D extends along substantially the entire width of paint bucket 10 from sidewall 20 to sidewall 21 as seen in FIG. 6, and like lower concave end 42 is sufficiently inwardly curved for accommodating the curvature of roller 36 of paint roller 37.

Horizontal support panel 35 is a quadrilateral panel and has a width that is equal to the width of central panel 34 and resides in the upper plane defined by continuous upper edge 14. Horizontal support panel 35 has opposing first and second end edges 35A and 35B, a first side edge 35C adjoining upper edge 23A of rear wall 23, and a second side edge 35D adjoining upper edge 41 of central panel 34.

Referring to FIG. 5, second support panel 32 adjoins first support panel 30, side edge 44 of central panel 34, and first end edge 35A of horizontal support panel 35. Second support panel 33 adjoins first support panel 31, side edge 45 of central panel 34, and second end edge 35B of horizontal support panel 35. Central panel 34 is a slanted, inset paint distribution board that is built into paint bucket 10.

The support provided by the structure resulting from the arrangement of first support panels 30 and 31, second support panels 32 and 33, and sidewalls 20 and 21 form opposing rearwardly projecting legs of paint bucket 10 that allow a paint roller to be rubbed against central panel 34 without risk of overturning paint bucket 10. Central panel 34 is preferably formed with corrugations of a selected design or pattern aid in the distribution of paint on a roller of a paint roller. Also, the structure provided by horizontal support panel 35, central panel 34, and second support panels 32 and 33 cooperate and form a central paint distribution box structure that extends into receptacle 17 from first and second support panels 30 and 31, which provides rear wall 23 with surprising and unexpected structural rigidity that prevents rear wall 23 from buckling and bending, which has long been a problem with prior art paint buckets having integrated paint distribution boards.

The opposing concave lower ends 42 and 22D of central panel 34 and front wall 22, respectively, and also the portion of bottom wall 16 extending between concave lower ends 42 and 22D, define a paint collection surface of paint bucket 10 over which a paint roller can be rolled back and forth for collecting paint from a charge of paint disposed in the bottom of paint bucket 10. As a result of the concave lower ends 42 and 22D that adjoin bottom wall 16, a paint roller can be easily and smoothly maneuvered back and forth over central panel 34, bottom wall 16 and front wall 22, in which there are no corners in the paint collection surface to form dead zones where paint can collect and where it is impossible to evenly and efficiently collect paint with a paint roller. In prior art paint buckets, there are corners in the paint collection surface between the continuous sidewall and the bottom wall of the paint receptacle, which create these dead zones where paint can collect and where it is impossible to maneuver a paint roller into and evenly and efficiently apply paint to the paint roller. The invention eliminates this by providing a paint collection surface defined by opposing concave lower ends 42 and 22D and the portion of bottom wall 16 extending therebetween. Because the opposing concave lower ends 42 and 22D eliminate corners in the bottom of paint bucket 10 along the paint collection surface of paint bucket 10 and the resulting dead zones in which paint can collect and at which it is impossible to load paint onto the paint roller in an even and efficient manner, paint waste that results from the dead zones is eliminated.

Figure 3:
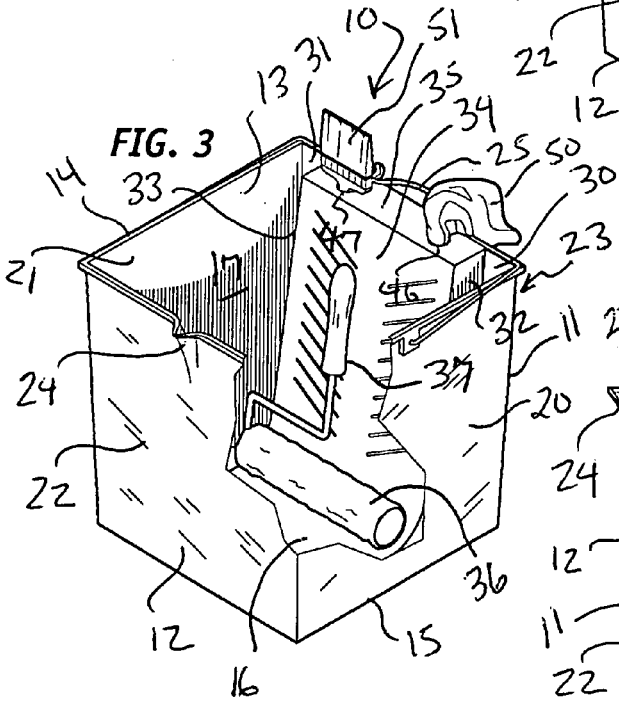
FIG. 3 is a view much like that of FIG. 2 and further showing a paint roller associated with the paint bucket and a brush and towel held in storage features of the paint bucket.

There is a first opening 46 through horizontal support panel 35 adjacent first end edge 35A between side edges 35C and 35D, and there is a second opening 47 through horizontal support panel 35 adjacent second end edge 35B between side edges 35C and 35D. Openings 46 and 47 are inset from upper edge 23A of rear wall 23. Openings 46 and 47 are each able to accommodate and receive therein a paint accessory for convenient access and storage. As a matter of example, FIG. 3 shows a towel 50 extending through, and being held in, opening 46, and the handle of a paint brush 51 extending through opening 47, in which the head of the paint brush is resting atop horizontal support panel 35 providing storage for paint brush 51. Openings 46 and 47 each may be used to hold other selected items as may be desired. Because openings 46 and 47 are inset from upper edge 23A of rear wall 23, items can be stored therein without risk of overturning paint bucket 10 and without imparting instability to paint bucket 10.

Figure 7:
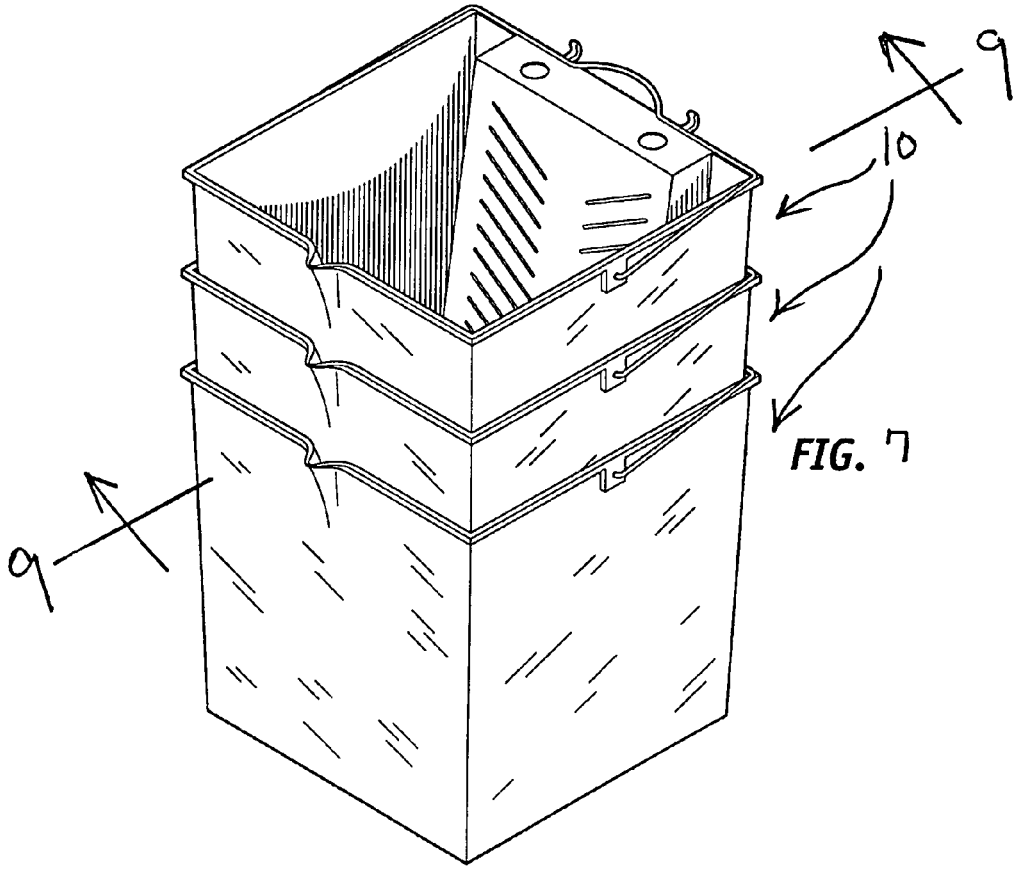
FIG. 7 is an isometric view of a plurality of identical paint buckets, each constructed and arranged in accordance with the paint bucket of FIG. 1, shown as they would appear nested.
Figure 8:
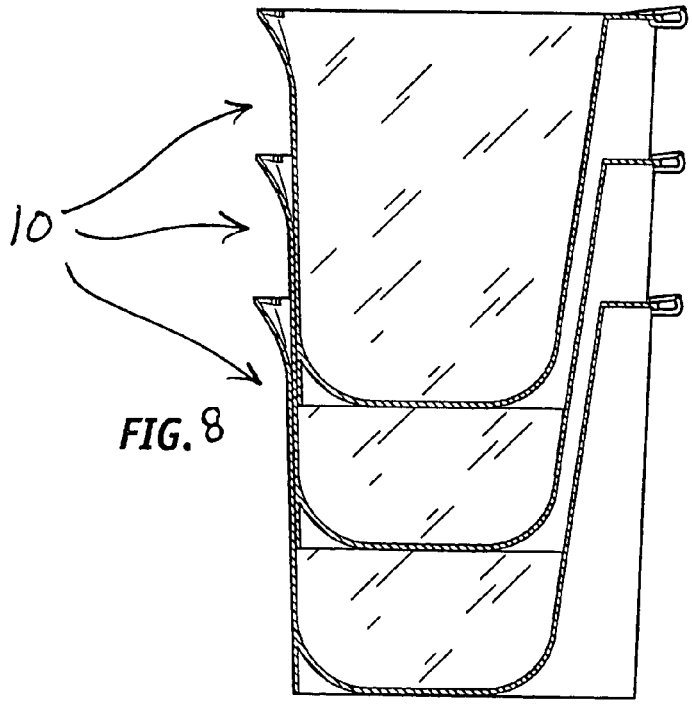
FIG. 8 is a sectional view taken along line 9-9 of FIG. 7.

Two opposing storage hooks 48 and 49 are affixed to, and extend rearwardly of, upper edge 23A of rear wall 23 between second support panels 32 and 33, and are available to be used for hanging towels, brushes, and other selected accessories. Also, paint bucket 10 is sized so that it is nestable with a duplicate paint bucket. FIGS. 7 and 8 illustrate a plurality of paint buckets each constructed in accordance with paint bucket 10 and shown as they would appear nested together.

The present invention is described above with reference to a preferred embodiment. However, those skilled in the art will recognize that changes and modifications may be made in the described embodiment without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A paint bucket, comprising:

a) fluid impervious receptacle formed from a single one-piece unitary structure comprising an upstanding continuous sidewall including opposing sidewalls having upper and lower edges, opposing front and rear walls having upper and lower edges, the upper edges of the sidewalls and the front and rear walls defining a continuous upper edge, defining an upper plane, of the continuous sidewall, and a substantially horizontal bottom wall, adjoined to the lower edges of the sidewalls and the front and rear walls and defining a bottom plane, cooperating with continuous sidewall to form the fluid impervious receptacle;

b) the upper plane substantially parallel to the bottom plane;

c) the rear wall comprising:

1) two first support panels each adjoining one of the opposing sidewalls;

2) a central panel having sufficient width to accommodate a roller of a paint roller, the roller having a curvature, the central panel having an upper end including an upper edge inset from the upper edge of the rear wall, and a lower concave end leading to an opposing lower edge adjoining the bottom wall, the lower concave end for accommodating the curvature of the roller;

3) a horizontal support panel, having a width equal to the width of the central panel and residing in the upper plane, that extends between and adjoins the upper edge of the rear wall and the upper edge of the central panel;

4) the lower edge of the central panel sufficiently inset from the upper edge of the central panel to form an incline between the lower edge of the central panel and the upper edge of the central panel;

5) two second support panels each adjoining one of the first support panels, the central panel, and the horizontal support panel; and 6) the horizontal support panel, the central panel, and the two second support panels together extend into the fluid impervious receptacle from the two first support panels to provide the rear wall with structural rigidity to prevent the rear wall from buckling and bending.

2. The paint bucket of claim 1, further comprising a pair of opposing storage hooks affixed to the upper edge of the rear wall between the two second support panels and extending rearwardly of the upper edge.

3. The paint bucket according to claim 1, wherein the paint bucket is sized so that the paint bucket is nestable with a duplicate paint bucket.

4. The paint bucket according to claim 1, further comprising a central spout formed at the upper edge of the front wall.

5. The paint bucket according to claim 1, wherein the central panel is corrugated.

6. The paint bucket according to claim 1, further comprising the front wall having a lower concave end leading to a lower edge adjoining the bottom wall, the lower concave end of the front wall for accommodating the curvature of the paint roller.

7. The paint bucket according to claim 1, further comprising a handle pivotally attached to the paint bucket for use in carrying the paint bucket.

8. A paint bucket, comprising:

a) fluid impervious receptacle formed from a single one-piece unitary structure comprising an upstanding continuous sidewall including opposing sidewalls having upper and lower edges, opposing front and rear walls having upper and lower edges, the upper edges of the sidewalls and the front and rear walls defining a continuous upper edge, defining an upper plane, of the continuous sidewall, and a substantially horizontal bottom wall, adjoined to the lower edges of the sidewalls and the front and rear walls and defining a bottom plane, cooperating with continuous sidewall to form the fluid impervious receptacle;

b) the upper plane substantially parallel to the bottom plane;

c) the rear wall comprising:

1) two first support panels each adjoining one of the opposing sidewalls;

2) a central quadrilateral panel having sufficient width to accommodate a roller of a paint roller, the roller having a curvature, the central quadrilateral panel having an upper end including an upper edge inset from the upper edge of the rear wall, and a lower concave end leading to an opposing lower edge adjoining the bottom wall, the lower concave end for accommodating the curvature of the roller;

3) a horizontal support panel, having a width equal to the width of the central quadrilateral panel and residing in the upper plane, opposing first and second end edges, a first side edge adjoining the upper edge of the rear wall, and a second side edge adjoining the upper edge of the central quadrilateral panel, the horizontal support panel extends between and adjoins the upper edge of the rear wall and the upper edge of the central panel;

4) the lower edge of the central quadrilateral panel sufficiently inset from the upper edge of the central quadrilateral panel to form an incline between the lower edge of the central quadrilateral panel and the upper edge of the central quadrilateral panel;

5) two second support panels each adjoining the central quadrilateral panel, one of the first support panels, and one of the first and second end edges of the horizontal support panel;

6) the horizontal support panel, the central quadrilateral panel, and the two second support panels together cooperate to form a box structure that extends into the fluid impervious receptacle from the two first support panels to provide the rear wall with structural rigidity to prevent the rear wall from buckling and bending;

7) a first opening through the horizontal support panel adjacent the first end edge between the first and second side edges; and 8) a second opening through the horizontal support panel adjacent the second end edge between the first and second side edges.

9. The paint bucket of claim 8, further comprising a pair of opposing storage hooks affixed to the upper edge of the rear wall between the two second support panels and extending rearwardly of the upper edge.

10. The paint bucket according to claim 8, wherein the paint bucket is sized so that the paint bucket is nestable with a duplicate paint bucket.

11. The paint bucket according to claim 8, further comprising a central spout formed at the upper edge of the front wall.

12. The paint bucket according to claim 8, wherein the central quadrilateral panel is corrugated.

13. The paint bucket according to claim 8, further comprising the front wall having a lower concave end leading to a lower edge adjoining the bottom wall, the lower concave end of the front wall for accommodating the curvature of the paint roller.

14. The paint bucket according to claim 8, further comprising a handle pivotally attached to the paint bucket for use in carrying the paint bucket.

15. A paint bucket, comprising:

a) fluid impervious receptacle formed from a single one-piece unitary structure comprising an upstanding continuous sidewall including opposing sidewalls having upper and lower edges, opposing front and rear walls having upper and lower edges, the upper edges of the sidewalls and the front and rear walls defining a continuous upper edge, defining an upper plane, of the continuous sidewall, and a substantially horizontal bottom wall, adjoined to the lower edges of the sidewalls and the front and rear walls and defining a bottom plane, cooperating with continuous sidewall to form the fluid impervious receptacle;

b) the upper plane substantially parallel to the bottom plane;

c) the rear wall comprising:

1) two first support panels each adjoining one of the opposing sidewalls;

2) a central quadrilateral panel having sufficient width to accommodate a roller of a paint roller, the roller having a curvature, the central quadrilateral panel having an upper end including an upper edge inset from the upper edge of the rear wall, and a lower concave end leading to an opposing lower edge adjoining the bottom wall, the lower concave end for accommodating the curvature of the roller;

3) a horizontal support panel, having a width equal to the width of the central quadrilateral panel and residing in the upper plane, opposing first and second end edges, a first side edge adjoining the upper edge of the rear wall, and a second side edge adjoining the upper edge of the central quadrilateral panel, the horizontal support panel extends between and adjoins the upper edge of the rear wall and the upper edge of the central panel;

4) the lower edge of the central quadrilateral panel sufficiently inset from the upper edge of the central quadrilateral panel to form an incline between the lower edge of the central quadrilateral panel and the upper edge of the central quadrilateral panel;

5) two second support panels each adjoining the central quadrilateral panel, one of the first support panels, and one of the first and second end edges of the horizontal support panel; and 6) the horizontal support panel, the central quadrilateral panel, and the two second support panels together cooperate to form a box structure that extends into the fluid impervious receptacle from the two first support panels to provide the rear wall with structural rigidity to prevent the rear wall from buckling and bending.

16. The paint bucket according to claim 15, further comprising:

a first opening through the horizontal support panel adjacent the first end edge between the first and second side edges; and a second opening through the horizontal support panel adjacent the second end edge between the first and second side edges.

17. The paint bucket of claim 15, further comprising a pair of opposing storage hooks affixed to the upper edge of the rear wall between the two second support panels and extending rearwardly of the upper edge.

18. The paint bucket according to claim 15, wherein the paint bucket is sized so that the paint bucket is nestable with a duplicate paint bucket.

19. The paint bucket according to claim 15, further comprising a central spout formed at the upper edge of the front wall.

20. The paint bucket according to claim 15, wherein the central quadrilateral panel is corrugated.

21. The paint bucket according to claim 15, further comprising the front wall having a lower concave end leading to a lower edge adjoining the bottom wall, the lower concave end of the front wall for accommodating the curvature of the paint roller.

22. The paint bucket according to claim 15, further comprising a handle pivotally attached to the paint bucket for use in carrying the paint bucket.

* * * * *